United States Patent [19]

Jordan

[11] 4,160,637

[45] Jul. 10, 1979

[54] APPARATUS FOR TREATING A SPINNERET PLATE TO BE REUSED INTO THE MANUFACTURE OF SYNTHETIC FIBERS

[75] Inventor: Theodore M. Jordan, Columbia, Md.

[73] Assignee: Westinghouse Electric Corp., Pittsburgh, Pa.

[21] Appl. No.: 869,072

[22] Filed: Jan. 12, 1978

[51] Int. Cl.[2] ..... D01D 3/00

[52] U.S. Cl. ..... 425/225; 29/DIG. 13; 219/10.71; 264/39

[58] Field of Search ..... 425/225, 226, 229, 192 S; 264/39; 29/700, 791, DIG. 13; 219/10.69, 10.71, 10.73

[56] References Cited

U.S. PATENT DOCUMENTS

| | | | |
|---|---|---|---|
| 2,506,425 | 5/1950 | Journeaux | 219/10.69 X |
| 2,663,789 | 12/1953 | Redmond | 219/10.71 |

FOREIGN PATENT DOCUMENTS

| | | | |
|---|---|---|---|
| 1228363 | 8/1960 | France | 219/10.69 |
| 6404 | 6/1962 | Japan | 425/192 S |

*Primary Examiner*—Robert D. Baldwin
*Attorney, Agent, or Firm*—C. M. Lorin

[57] ABSTRACT

A spinneret pack comprising a filtration assembly and an outer ring surrounding the spinneret plate, when it is clogged with unprocessed plastic material, is preheated by induction heating to separate the outer ring by slight pressure in a first processing step, then a second induction heating treatment separates the spinneret plate from the attached filtration assembly. The spinneret plate, detached by gravity, has matter in the die holes carbonized by the second induction heating process, thereby simplifying a final cleaning process which will make the spinneret plate reusable in the synthetic fiber manufacturing process.

1 Claim, 8 Drawing Figures

FIG. 1
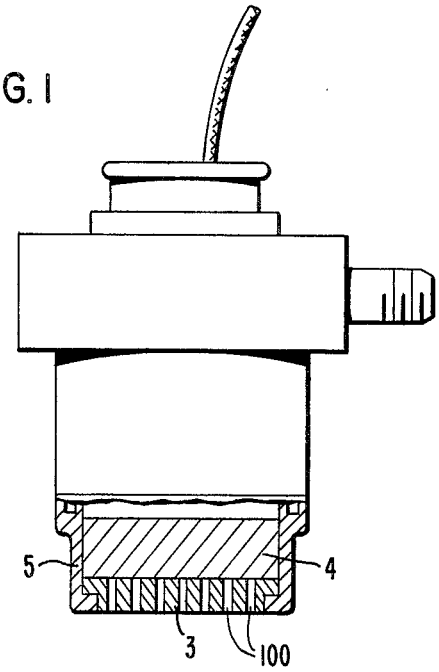
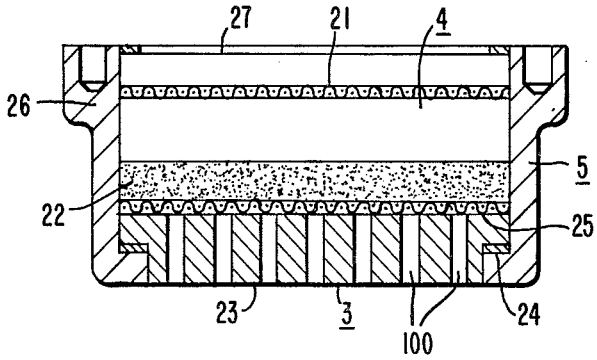
FIG. 2

APPARATUS FOR TREATING A SPINNERET PLATE TO BE REUSED INTO THE MANUFACTURE OF SYNTHETIC FIBERS

BACKGROUND OF THE INVENTION

The invention relates in general to the manufacture of synthetic fibers and more particularly to the maintenance of the spinneret plates used in the spinning heads of a textile mill to generate fibers by extrusion through very fine holes therein.

The spinneret plate is the die used for extrusion of polymer forced therethrough. It is made of hard and expensive metal. The holes which can be of any form or size are tooled with precision. In the process the holes tend to be clogged with unprocessed material so that the spinneret plate has to be changed from time to time. The spinneret plate taken away from production is not wasted but cleaned thoroughly before being reused to replace another one. Since there are many spinning heads in a textile mill, the cost of spinneret plates is important. Therefore, the speed and thoroughness of the cleaning operation are an essential part of the manufacturing operation.

The object of the present invention is to provide an improved method and/or apparatus for cleaning the spinneret plates of a textile mill.

When the spinneret plate is to be replaced, the operator is not able to take away from the spinning head only the spinneret plate. In fact, behind the spinneret plate a filtration assembly is always inserted to filter the polymer before it reaches the holes of the die. An outer ring surrounds both the filtration assembly and the spinneret plate for mounting in the spinning head, and all three pieces become a unitary mass when plastic material has set in the holes in the filtration assembly, and at the junction with the outer ring. The unit so formed is known as the spinneret pack. The operator takes away the spinneret pack and replaces it by new and separate parts, namely, a spinneret plate, a filtration assembly and an outer ring which are tight together once mounted within the spinning head.

The general practice in the industry to clean the spinneret plate has consisted of burning away the polymer in an oven in order to disassemble the pack and obtain a spinneret plate which is relatively clean. A further step is required consisting in cleaning the holes of the spinneret plate chemically, e.g. with a solution fluid enough to penetrate the holes. Heat treatment by the oven takes up to eight hours at 800° F. The polymer is burned and smoke with toxic gases evolve which cause air pollution when out of the chimney of the furnace. Ultrasonic cleaning is well known, and its application to workpieces of unusual shape, with recesses and tiny holes is particularly in order. Nevertheless, the only treatment leaves, with the carbonized polymer, residues which necessitate at least an initial cleaning step by a chemical solution before the usual ultrasonic cleaning process can be successfully applied to the spinneret plate. A water and alcohol solution is generally used to condition the spinneret plate. Then, a solvent such as a NaOH caustic solution is able to penetrate the holes and cause the required cavitations therein under the ultrasonic waves. If such a solution is not sufficient, Freon gas is commonly used as solvent because it penetrates most easily into the die holes. Fluorocarbons are useful as final cleaner because they are most effective with a low surface tension, to cavitate within the holes.

Another object of the present invention is to process the spinneret pack from a spinning head without recourse to oven treatment, and to condition the spinneret plate for improved final cleaning thereof.

SUMMARY OF THE INVENTION

In accordance with the present invention the spinneret pack is first preheated by induction heating until the outer ring is detached from the pack, but not long enough to detach the spinneret pack from the filtration assembly and entrapped polymer. As a result of the outer ring being taken away selectively, the spinneret and filter assembly with polymer becomes exposed for further heat processing. Since induction heating in the first preheating step only involves the outer ring, the metal of the spinneret plate is practically unheated, except for the outside walls. Had the pack been placed into an oven the parts would have been brought to say 800° C. and the spinneret plate would be very hot at this stage, once the polymer had been burned away.

The next step consists of heating spinneret plate in an induction coil to separate it from the filter assembly with entrapped polymer and to carbonize the polymer material within the spinneret holes. The spinneret plate separates by gravity. The spinneret plate, being made of metal, is practically not heated in the process and the heat developed by induction heating concentrates only in the holes of the spinneret pack. Carbonization of the polymer material in the holes is assured by latent heat within the spinneret plate.

Once the spinneret plate has been detached from the filtration assembly, the latter is discarded. The spinneret plate is in a perfect condition for a final cleaning process, much better than would be possible with an oven treatment. Ultrasonic cleaning is the preferred mode for cleaning the carbonized spinneret plate. Depending on the narrowness of the die holes, a chemical solution can be used or Freon gas should be used to penetrate deep into the holes so that carbonized material can be removed by ultrasonic action on the solvent.

It is known on the one hand from U.S. Pat. No. 2,620,286 of Morris R. Shaw to remove carbonaceous deposits from the interior of still tubes by induction heating, and on the other hand from U.S. Pat. No. 3,762,952 of Albert J. Gouin to remove polymer deposits from surfaces of process equipment by a solvent while loosening the deposits by ultrasonic vibrations or a water wash. These steps, however, cannot be successfully used individually for the specific goal achieved with the present invention.

Accordingly, the invention comprises a method for selectively separating a spinneret pack by induction heating in two steps, the first step consisting in preheating the pack until the outer ring thereof is detached from the two other parts, the second step consisting in heating the two other parts until the spinneret plate is detached from the filtration assembly, carbonization of the material clogging the die holes being substantially achieved through the said second step.

The invention further comprises the third step of cleaning chemically the die holes of a spinneret plate treated by the said first and second steps so as to remove any carbonized matter from the said die holes. More specifically, the said third step is conducted by ultrasonic cleaning with a selected solvent of said carbonized matter.

From another aspect of the invention, apparatus is provided including: first coil means for applying induction heating to said pack under said first preheating step during first time period sufficient to detach the outer ring from the two other parts of said pack; second coil means for applying induction heating to said two other parts under said second heating step during a second time period sufficient to detach the filtration assembly from the spinneret plate after carbonization of matter clogged in the die holes thereof.

The apparatus according to the present invention comprises transportation means for loading a plurality of spinneret pack, transporting the loaded pack to a first operative station in proximity to said first coil means, then to a second operative station in proximity to said second coil means, the outer ring being separated by slight pressure and the spinneret plate being detached by gravity at the respective first and second operative stations.

The two operative stations are used in parallel with two successive sets of loaded spinneret packs, while the outer ring and filtration assemblies are discarded, the spinneret plates being collected at said second station for further processing, e.g. for cleaning, in particular by ultrasonic cleaning technique.

BRIEF DESCRIPTION OF THE DRAWINGS

FIG. 1 shows a typical spinning head of a textile mill with a spinneret pack comprising a spinneret plate (3), a filtration assembly (4) and an outer ring (5) mounted thereon;

FIG. 2 shows in detail the spinneret pack;

DESCRIPTION OF THE PREFERRED EMBODIMENT

Figure 3:
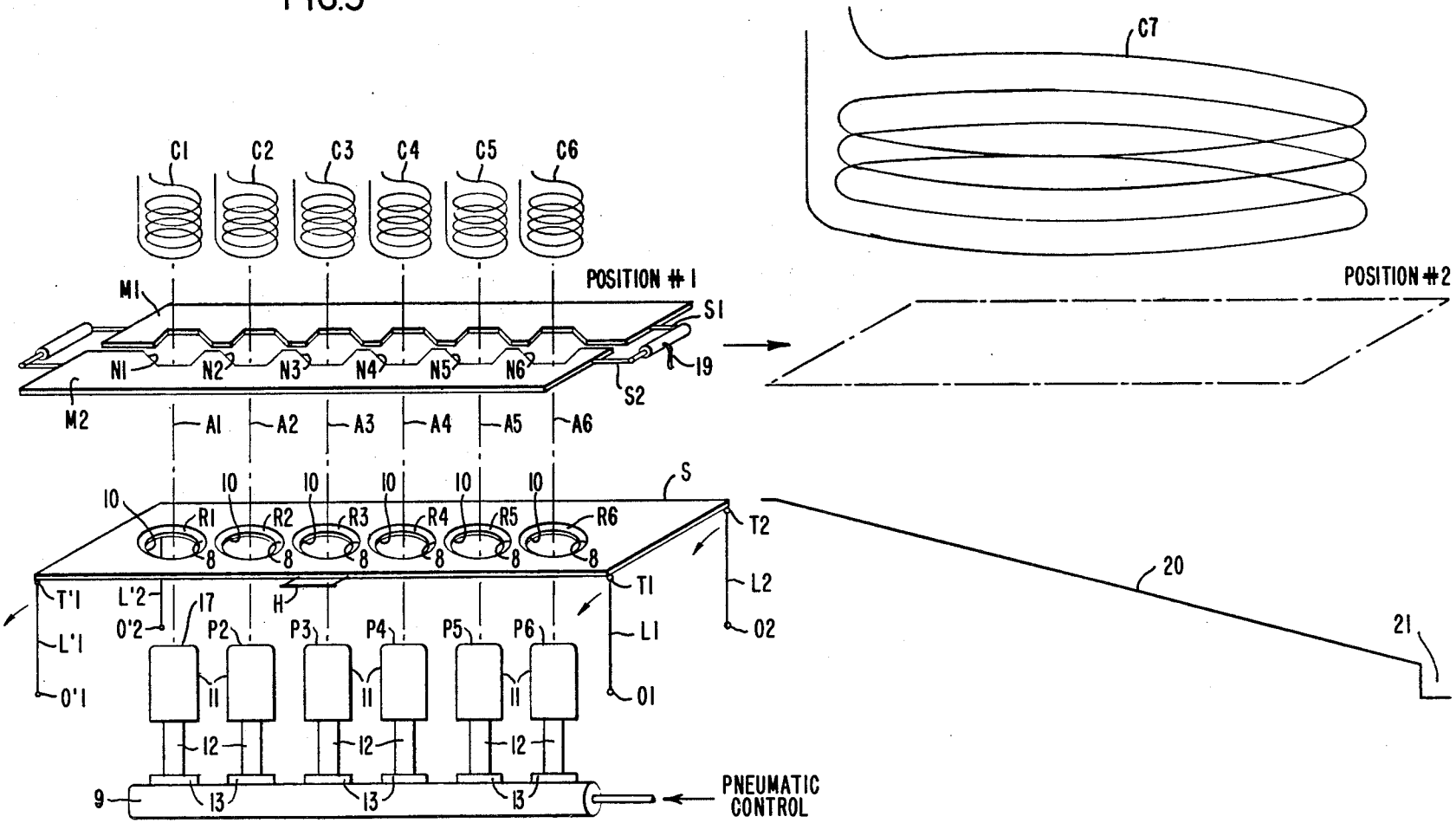
FIG. 3 shows apparatus according to a preferred embodiment of the invention.

FIG. 1 shows the spinning head of a machine used for the extrusion of polymer material in the manufacture of synthetic fibers. The spinning head 1 holds, against the rim 2 defining the outlet of the spinning head, three parts: the spinneret plate, which has perforations, or holes, 100, which rests against the rim 2, the filtration assembly 4 which is backing against the spinneret plate 3 and the outer ring 5 which surrounds both the spinneret plate and the filtration assembly 4. These three parts together form the spinneret pack. The spinneret pack is shown with more details on FIG. 2. FIG. 2 shows a typical spinneret pack with the three major parts: outer ring, filtration assembly and plate. 21 is a 60 mesh top screen made of stainless steel. 22 is sand (approximately 85 cc). 23 is the face of the spinneret upon which emerge the die holes (not shown). 24 is the spinneret gasket, of aluminum. 25 is the pack screen comprised of two layers with aluminum binder (press fit). 26 is the pack body made of steel. 27 is the top seal made of aluminum. The outer ring 5 is generally made of steel. In contrast, the spinneret plate is made of expensive alloy steel.

The spinneret plate is the extrusion die proper of the spinning head. The polymer material is forced through holes 100 which, depending on the manufacturing requirement, may range from 40 to 200$\mu$ in diameter. These holes must be perfectly smooth. The number of holes ranges from 1 to many. The spinneret plate is made to high precision standards. The orifices which can be of any shape are held to tolerances of 1$\mu$. The spinneret plate is the most important single part for the manufacture of synthetic fiber; it is costly and therefore, should not be wasted. It has a long life provided it is kept clean from time to time in order to be effective at the outlet of the spinning head.

After some time in the manufacturing process, the holes tend to be clogged. When this happens plastic material ceases to flow through the die and the three parts 3, 4 and 5 become integrated by the unprocessed and hardened material. Thus, when it is time to replace the spinneret plate 3, the operator in fact takes away from production the entire spinneret pack including outer ring and filtration assembly as well as spinneret plate.

The present invention provides the necessary means for separating the three elements of the spinneret pack, and cleaning the spinneret plate with the required conditions of rapidity and thoroughness, considering that a textile installation usually includes very many spinning heads, and a considerable number of spinneret plates have to be handled in the cleaning process.

Referring to FIG. 3, apparatus is shown for implementing the method according to the invention and for automatically separating the elements of the spinneret pack and placing the spinneret plate in suitable condition for a final step consisting of ultrasonic cleaning. The filtration assembly detached in the process can be wasted and is thrown away.

FIG. 3 shows six individual coils $C_1$ to $C_6$ used for preheating the spinneret packs and for separating the outer ring 5 from the pack. A single coil $C_7$ used for a second heating step is shown laterally of the six first-mentioned coils. These coils are induction heating coils. Typically, with the preferred embodiment of the invention, a power supply of 480 volts three-phase 60 hertz is converted into a single phase power supply of 30 KW at 3000 hertz. A capacitor and voltage adjusting transformer network is connected with the incoming line contactor to provide an output of approximately 800 volts. The six coils $C_1$–$C_6$ are connected in series. They are cooled by water treated to provide a resistivity of 2000 $\Omega$/cm, the coolant being supplied from a storage tank with circulating pump and a heat exchanger. Coil $C_7$ is power-supplied and water-cooled in the same conditions. It is an elongated coil embracing the same geometrical space as the six individual coils $C_1$–$C_6$, so that the same number of articles can be treated in parallel with the six individual coils.

Six spinneret packs such as shown in FIG. 2 are placed on a tray having six receptacles $R_1$–$R_6$ such as shown. Preferably, the tray can be pulled forward for loading. Articulations $L_1$, $L_2$, $L'_1$ $L'_2$ are provided between fixation points $T_1$ $T_2$ and $T'_1$ $T'_2$ on the tray and pivots $O_1O_2$, $O'_1$, $O'_2$. The tray is shown in rest position after being pulled back by the operator holding handle 4 of the tray. Indeed, the loading operation and tray motions can be made automatic. Typically, the six receptacles $R_1$–$R_6$ have a portion 8 which substantially match the lower part of the outer ring of the spinneret pack of FIG. 2, and an opening 10 is provided at the center of each receptacle.

When the tray is in the next position as shown, the openings 10 are centered on the axes ($A_1$–$A_6$) of the respective individual coils $C_1$–$C_7$. Aligned with these axes are provided six pedestal mechanisms $P_1$–$P_6$ controlled pneumatically by an actuator 9. These mechanisms each include a pedestal member 11, a rod 12 and a cylinder 13 for conventionally extending along the axes ($A_1$–$A_6$) the pedestal member from a retracted position (as shown in FIG. 3) to a fully extended position for which the front face 17 of the pedestal member is in proximity with the active heating space of the opposite individual coil ($C_1$ for mechanism $P_1$).

Between the tray in the rest position and the front plane of coils $C_1$–$C_6$, an open clamp is provided comprising jaws $M_1$ and $M_2$ which each have notches defining clamping zones $N_1$–$N_6$ centered on the respective axes $A_1$–$A_6$. When the clamp is open and in the position #1, as shown, zones $Z_1$–$Z_6$ have such cross dimensions that the largest cross dimension of a spinneret pack on a receptacle $R_1$–$R_6$ of the tray is fully embraced by $N_1$ . . . or $N_6$.

Figure 4C:
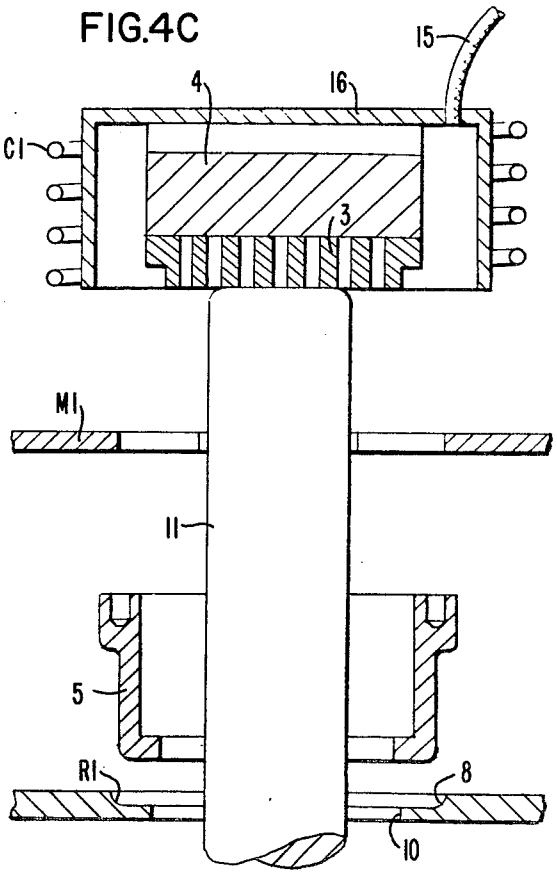
FIGS. 4A, 4B and 4C show the pedestal means of the apparatus of FIG. 3 in relation with the spinneret pack for three different stages of operation.
Figure 4B:
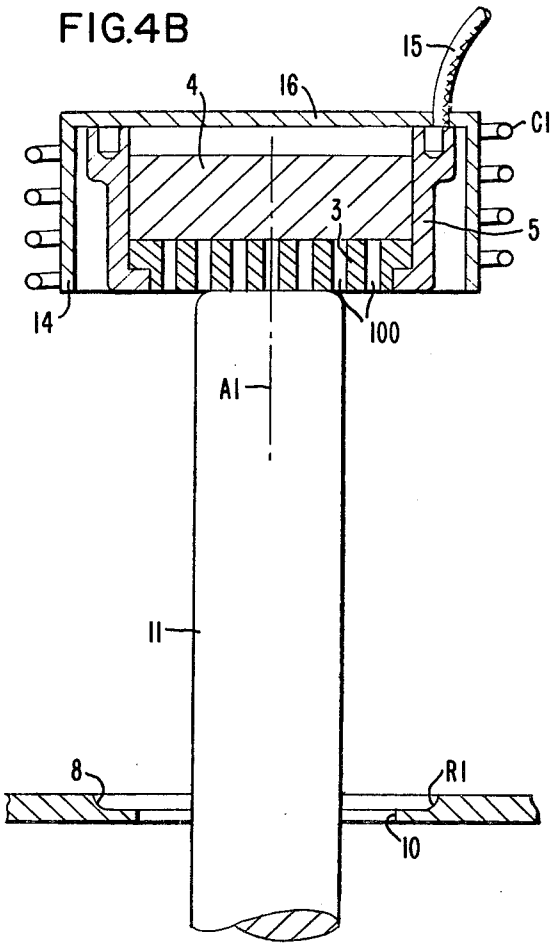
Figure 4A:
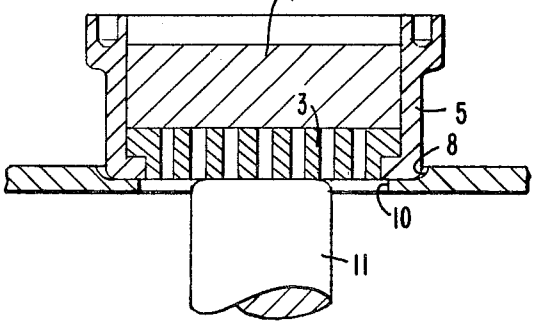
Figure 4D:
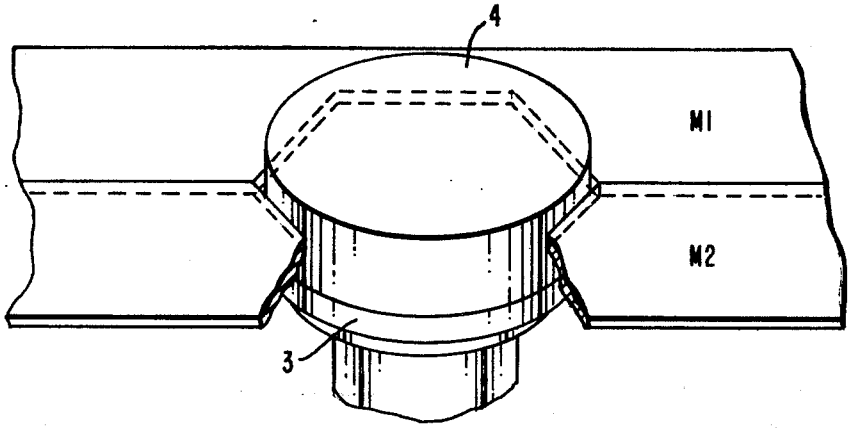
FIG. 4D shows the clamping means of the apparatus of FIG. 3 engaging the filtration assembly after the outer ring has been detached from it.
Figure 5:
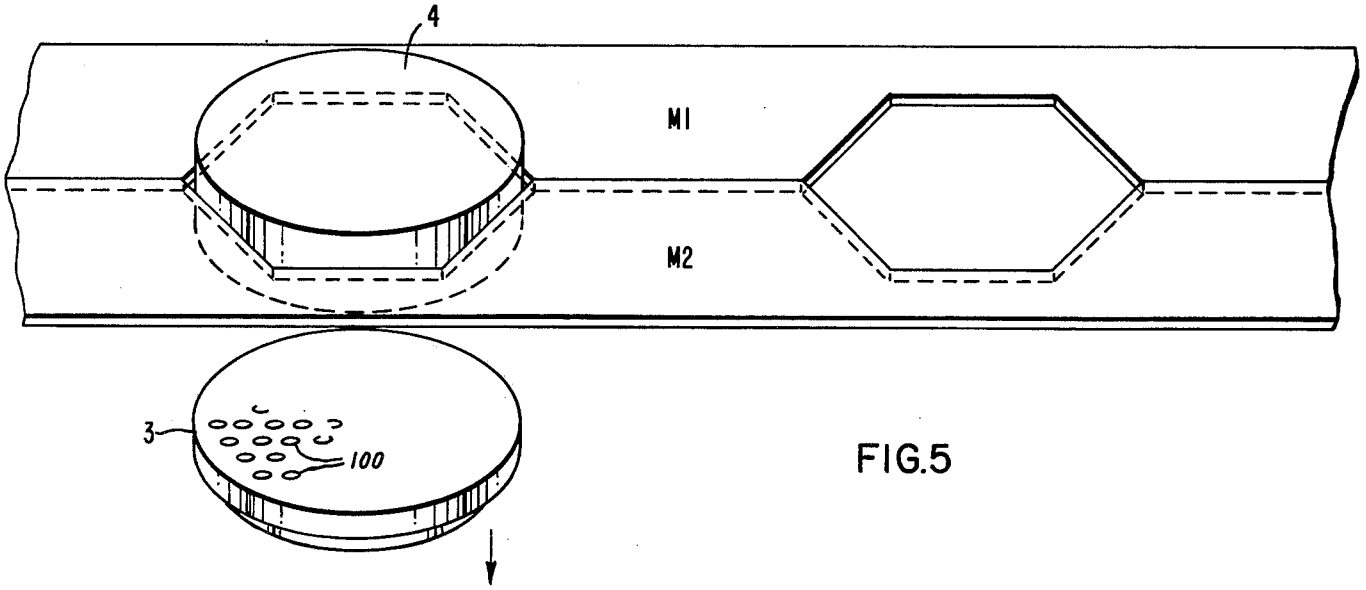
FIG. 5 shows the spinneret plate being detached from the filtration assembly held by the clamping means at the second operative station of the apparatus of FIG. 3.

The positions shown for the tray and the clamp are the initial positions. Assuming at least one spinneret pack has been placed on the tray, say on receptacle $R_1$, when pedestal member 11 of mechanism $P_1$ is extended through the opening 10 toward the fully-extended position in close proximity to individual coil $C_1$, the front face 17 first engages the down face 18 of the spinneret plate 3 in the opening 10 of the tray, as shown in FIG. 4A. Further motion upward of pedestal member 11 lifts the spinneret pack from the tray, and carries it as a unit into the upper individual coil $C_1$ as shown by FIG. 4B. Coil $C_1$ surrounds a heating chamber defined by a wall 14 and a ceiling 16. The dimension of the heating chamber is such that the spinneret pack is completely and snugly within. At this moment the induction heating operation by coil $C_1$ (as well as the other coils $C_2$–$C_6$ which are in series) is performed on the spinneret pack. A first time period is counted for induction heating. Typically in 15 seconds, sometimes in 80 seconds depending on the size and type of spinneret pack, the outer ring is detached from the combined filtration assembly 4 and spinneret plate 3, but such time period is not extended after such separation, so that assembly 4 and plate 3 remain as a unit on the pedestal member 11. FIG. 4C shows the outer ring detached and falling by gravity around pedestal member until it comes to rest on the receptacle of the tray under it. In order to facilitate separation preferably pneumatic pressure is applied at the top of the heating chamber as shown at 15. It is also possible to assist in early separation by providing a finger (not shown) along ceiling 16 above the outer ring 5 which can be actuated pneumatically while induction heating is performed on the spinneret pack. After the outer ring 5 has been dropped into the receptacle $R_1$ on the tray, pedestal member 11 is retracted by actuator 9 from a fully-extended position to a partially-extended position which is intermediate between the heating chamber (14,16) and the rest position of the tray. As a matter of fact, the intermediate position of pedestal member is such that the filtration assembly 4 is in the plane of the clamp and its jaws $M_1$, $M_2$. At this time closing of the clamp is actuated by a manually operated mechanism 19 which applies at points $S_1$ $S_2$ (see FIG. 3) converging forces on jaws $M_1$ and $M_2$. The notches defining zones $N_1$–$N_6$ come closer as the teeth defined between notches reach close proximity. As a result, as shown by FIG. 4D the filtration assembly 4, which is resting with plate 3 on the front face 17 of the pedestal member is clamped between $M_1$ and $M_2$, so that pedestal member 11 can be retracted completely. When this is done, spinneret plate 3 is still attached to the filtration assembly 4. A mechanism (not shown) then slides the clamp from position #1 (shown in FIG. 3) to position #2 for which all zones $N_1$–$N_6$ are facing coil $C_7$. The plane of the clamp in position #2 is such that coil $C_7$ is in close proximity to the clamped filtration assembly 4 and attached plate 3. At this moment, a second time period for induction heating is established with induction coil $C_7$. The second period is chosen of sufficient duration to carbonize the plastic material clogged inside the fine holes of the spinneret plate 3. It is also sufficient to detach by gravity the spinneret plate 3 from the clamped filtration assembly 4, as shown in FIG. 5. The second period is of the same order as the first period, so that preheating with coils $C_1$–$C_6$ can be performed on one set of spinneret pack from the tray while a previous set of combined filtration assembly 4 and spinneret plate 3 is heat treated by coil $C_7$. Outer rings 5 are falling on the tray, while from under coil $C_7$ and the lamp in position #2 spinneret plates 3 are being dropped along an incline 20 leading to a chute 21 where they are collected for further processing by ultrasonic cleaning. The pneumatic actuator withdraws the pedestal member until an intermediate position which coincides with the plane of position #1. The clamps opens and drops the filtration assemblies 4 which are disposed of, then it slides back from position #2 into position #1 ready to squeeze and hold another set of filtration assemblies 4. Pedestal members are withdrawn further back. When the clamp slides into position #2 before coil $C_7$, the tray is loaded and brought back to rest position so that another cycle can start with coils $C_1$–$C_6$ and coil $C_7$ in parallel.

To summarize: In producing man-made fibers, i.e., polyesters and nylons, etc., hard pellets are melted in an extruder and pumped through a spinneret where the polymer is extruded and solidified to form continuous filaments.

The spinneret must be frequently taken out of service and the hardened polyester or nylon has to be removed. The spinneret pack must be cleaned before being returned to service. The conventional method is to "burn out" the pack, separate the assembly and further burn out matter until all residual nylon/polyester has been carbonized. This is done in electric or gas furnaces and takes up to 8 hours.

The process according to the present invention uses induction heating to carbonize the nylon/polyester present in the spinneret holes. This overall process takes less than 5 minutes to completely carbonize all residues. The spinneret is thereafter ultasonically cleaned using a very high watt density, 10 watts per square inch, or higher ultrasonic cleaner using an alkaline in water solution at 180° F. The spinnerets are then tap water rinsed, ultrasonic rinsed and blown dry with forced air. Spinnerets are then ultrasonically cleaned in a high watt density ultrasonic Freon vapor degreaser. This final stage permits low surface tension fluorocarbon solvent to penetrate very small spinneret holes, which are too small to accept high surface tension water or water-based chemicals. Once in the holes, the solvent is captivated by the ultrasonics and a complete cleaning of the die is possible.

I claim:

1. An apparatus for treating by induction heating a spinneret pack including an outer ring surrounding a combined spinneret plate and filter assembly, said filter assembly, spinneret plate and outer ring being united by unprocessed polymer material fed for extrusion through said filter assembly and through holes in said spinneret plate during the manufacturing of synthetic fibers; the apparatus comprising:

first heating coil means having a plurality of individual coils;

second induction heating coil means;

a tray having a plurality of receptacles for receiving in a one to one relationship a like plurality of spinneret packs when in a loading position;

said first coil means including a like plurality of individual heating coils each associated to a spinneret pack;

said tray being movable from said loading position into a rest position for which said receptacles are aligned with the respective said individual coils;

each receptacle having a bottom surface defining an opening, with each said bottom surface being adapted to receive one of said packs with the spinneret plate face down;

a like plurality of pedestal members movable along the common axes of said individual coils and said openings when said tray is in the rest position, said pedestal members being movable from a retracted position to a fully-extended position and back to a partially-extended position intermediate between said fully-extended position and said rest position;

each of said pedestal members being adapted to pass through a corresponding one of said openings of said tray when the tray is in said rest position, said rest position being located between said retracted and said partially-extended positions of the pedestal members;

whereby said packs are lifted from said tray in the rest position by the respective said pedestal members through said openings and brought into a heating position corresponding to said pedestal members in said fully-extended position, with said first heating coil means preheating said pack during a first time period sufficient to detach by gravity each of said outer rings from the respective said packs onto a corresponding receptacle of said tray;

with means operative on each combined filter assembly and spinneret plate, when said pedestal members are retracted to said partially-extended position, for transferring said filter assembly and spinneret plate as a unit into an operative position relative to said second induction heating coil means;

said second coil means being operable upon each said combined filter assembly and spinneret plate during a second time period sufficient to carbonize the material accumulated during extrusion in the holes of any of said spinneret plates and to detach each of said spinneret plates from the associated filter assembly by gravity; and means for collecting the detached spinneret plates.

* * * * *